US005212910A

United States Patent [19]

Breivogel et al.

[11] Patent Number: 5,212,910

[45] Date of Patent: May 25, 1993

[54] COMPOSITE POLISHING PAD FOR SEMICONDUCTOR PROCESS

[75] Inventors: Joseph R. Breivogel, Beaverton; Sam F. Louke, Portland; Michael R. Oliver, Tigard; Leo D. Yau, Portland, all of Oreg.

[73] Assignee: Intel Corporation, Santa Clara, Calif.

[21] Appl. No.: 727,829

[22] Filed: Jul. 9, 1991

[51] Int. Cl.[5] ..... B24D 11/00

[52] U.S. Cl. ..... 51/398; 51/395; 51/407; 51/131.3; 51/317

[58] Field of Search ..... 51/131.4, 131.3, 281 SF, 51/395, 396, 397, 398, 401, 407, 317, 318

[56] References Cited

U.S. PATENT DOCUMENTS 5,127,196 7/1992 Morimoto et al. ..... 51/165.73

FOREIGN PATENT DOCUMENTS 0004454 10/1979 European Pat. Off. ..... 51/398

*Primary Examiner*—Bruce M. Kisliuk
*Assistant Examiner*—Eileen P. Morgan

[57] ABSTRACT

An improved composite polishing pad includes a first layer of elastic material, a second, stiff layer and a third layer optimized for slurry transport. This third layer is the layer against which the wafer makes contact during the polishing process. The second layer is segmented into individual sections physically isolated from one another in the lateral dimension. Each segmented section is resilient across its width yet cushioned by the first layer in the vertical direction. The physical isolation of each section combined with the cushioning of the first layer of material create a sort of "bedspring" effect which enables the pad to conform to longitudinal gradations across the wafer.

30 Claims, 6 Drawing Sheets

COMPOSITE POLISHING PAD FOR SEMICONDUCTOR PROCESS

FIELD OF THE INVENTION

The invention relates generally to the field of semiconductor processing; in particular, to polishing pads utilized in conjunction with processes for mechanical planarization of the surface of a dielectric layer formed over a silicon substrate.

BACKGROUND OF THE INVENTION

Mechanical planarization of a semiconductor substrate involves polishing the front surface of a wafer. The planarization is aimed at reducing the step height variations of a dielectric layer formed on the substrate's surface. Most often, the dielectric layer to be removed comprises a chemical vapor deposition (CVD) of silicon dioxide. The thickness of the step height variations lies in the range of approximately 1 micron. In most cases, the series of non-planar steps which characterize the dielectric layer have dimensions which correspond to the underlying metal lines.

According to conventional mechanical planarization techniques, the substrate is placed face down on a table covered with a pad which has been coated with an abrasive material. The silicon wafer is actually mounted to a carrier plate which is coupled to a mechanism designed to provide a downward pressure onto the substrate. Both the wafer and the table are then rotated relative to each other. The presence of the abrasive particles removes the protruding portions of the dielectric layer and physically smooths the surface of the wafer. Ideally, the goal of this type of planarization processing is to completely flatten the surface topography of the wafer.

Unfortunately, semiconductor wafers are not always entirely flat. Frequently, mechanical stresses in the crystal lattice structure produce longitudinal gradations across the wafer's surface. In effect, the surface of the silicon wafer is characterized by a gradual waviness which interferes with the uniformity of the polishing process. What happens is that some areas of the wafer end up getting overpolished, while other regions remain underpolished. To overcome the problem of non-uniform polishing, practitioners have concentrated their efforts at developing a new type of polishing pad—one that is capable of conforming to the gradual, longitudinal height variations exhibited across the semiconductor substrate surface.

At present, their efforts have resulted in a trade-off between the polishing uniformity, as measured across the wafer, and the degree of planarity achieved in more localized areas (i.e., across individual die). This trade-off reflects the fact that past approaches have either relied on very soft pads or on extremely hard ones. Soft pads generally result in good uniformity, but poor planarity, while hard pads produce good planarity, but poor uniformity.

To improve this situation, a two-layer pad has been attempted. This type of pad is made up of a hard, stiff material (in contact with the wafer) which is supported by a soft, compressible layer underneath. The object was to have the soft pad absorb most of the long range wafer height variations while the hard pad resisted bending over a moderate distance (e.g., a die spacing or less).

Unfortunately, these prior art schemes still compromise the polishing performance on two main counts. First of all, while the upper pad is intended to be stiff, it cannot be made to be too stiff, otherwise it will act as an inflexible, rigid surface, and any benefit from the underlying soft pad would be totally eliminated. Thus, the upper pad must conform or bend in such a design. Of course, this provides less than perfect planarity according to conventional methods. Realizing a pad having both good uniformity and planarity has been problematic in the past.

Secondly, while the upper pad is generally optimized for stiffness, such hardness is undesirable from the standpoint of transporting the water-based polishing medium (i.e., slurry). When slurry transport is compromised, the result is poor polishing uniformity and polishing grades. Hence, what is needed is an improved polishing pad which overcomes the above-described shortcomings.

SUMMARY OF THE INVENTION

An improved composite polishing pad for use in mechanical planarization processes, wherein the surface of a dielectric layer formed over a silicon substrate is abrasively smoothed, is described. The structure of the invented composite polishing pad comprises a first layer of elastic material which is attached to a polishing table. This first layer acts as a cushioning layer to the subsequent overlying layers. A second, stiff layer covers the elastic layer. This second layer acts as a support layer and is covered by a third layer of material. The third layer is optimized for slurry transport. This third layer comprises the surface layer against which the wafer makes contact during the polishing process.

In one particular embodiment, the second layer is segmented into individual sections physically isolated from one another in the lateral dimension. Each segmented section retains its resiliency across its width while, at the same time, it is cushioned by the first layer in the vertical direction. The physical isolation of each section combined with the cushioning of the first layer of material create sort of a "bedspring" effect, which enables the pad to conform to longitudinal gradations across the wafer.

In a preferred implemention, the rigid second layer pad sections resemble an array of tiles separated by channel regions. These channel regions improve the polishing process by channelling slurry across the surface. The tile pattern may vary for different embodiments. The key feature is that each segment includes an independent suspension means (independent of its neighboring segments) which permits the segment to move up or down in a vertical direction, supported by the soft cushioning first elastic layer. The lateral dimension of the segment is preferably determined by the distance for which good localized planarity is required. When polishing a semiconductor substrate, this dimension is generally determined based on the physical size of the integrated circuit being planarized.

BRIEF DESCRIPTION OF THE DRAWINGS

The present invention is illustrated by way of example and not limitation in the figures of the accompanying drawings, in which like references indicate similar elements, and wherein.

DETAILED DESCRIPTION

An improved composite polishing pad for a semiconductor planarization process is disclosed. In the following description, numerous specific details are set forth such as specific material types, thicknesses, geometries, etc., in order to provide a thorough understanding of the invention. It will be obvious, however, to one skilled in the art that these specific details need not be used to practice the present invention. In other instances, well known structures, material properties, and processing steps have not been described in particular detail in order to avoid unnecessarily obscuring the present invention.

Figure 1:
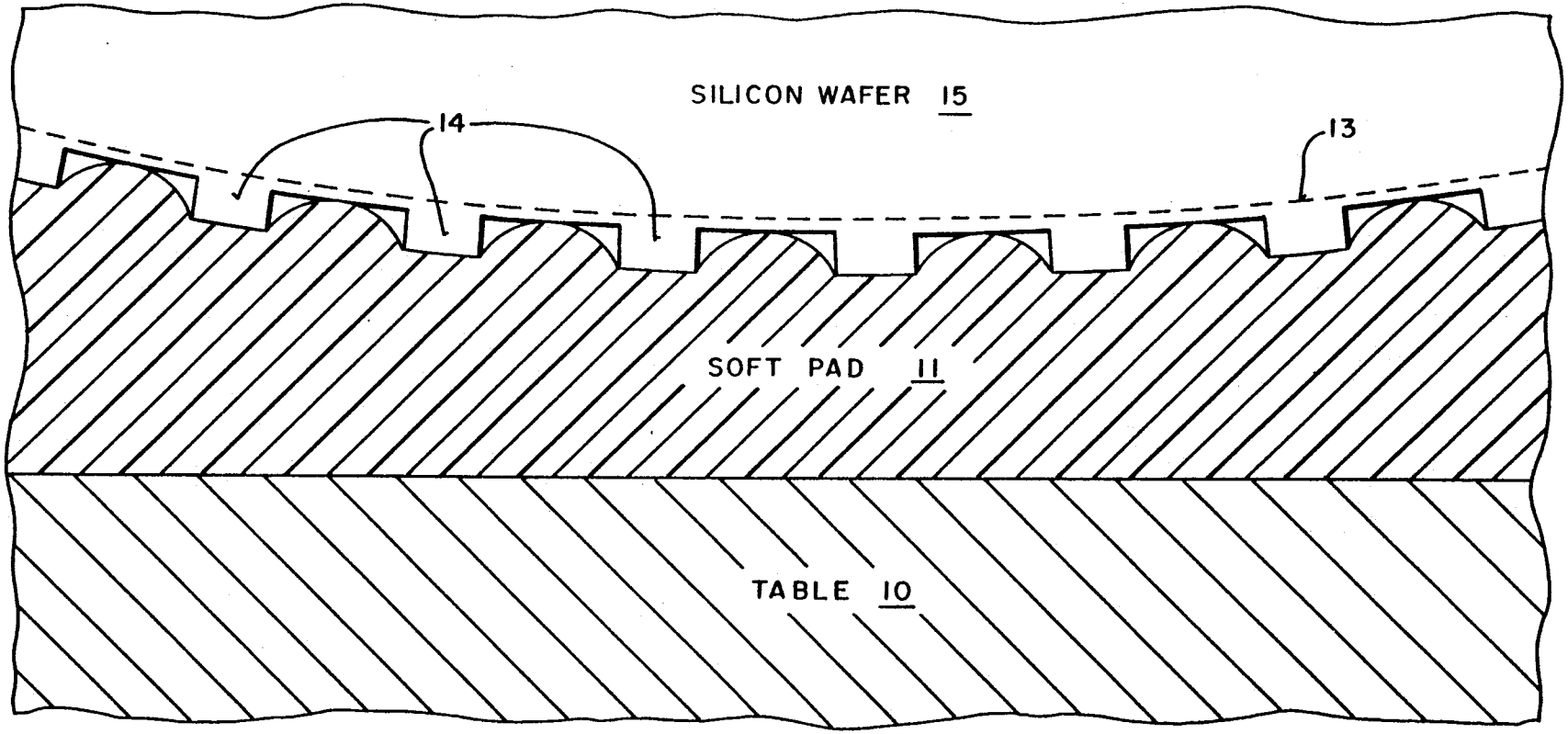
FIG. 1 (PRIOR ART)
FIG. 1 is a cross-sectional view of a prior art polishing pad.

With reference to FIG. 1, there is illustrated a cross-sectional view of a prior art soft polishing pad 11. Pad 11 is shown attached to the surface of rigid polishing table 10. The figure also depicts a silicon wafer 15 whose upper surface is pressed into soft pad 11, as is the case during a typical polishing session. Note that silicon wafer 15 is characterized by a longitudinal gradation which is indicated by dashed line 13.

On a smaller, more localized level, wafer 15 includes numerous step height variations or protrusions 14 along its surface. These variations 14 result from the normal fabrication sequence of an integrated circuit on wafer 15. Typically, protrusions 14 comprise a dielectric layer such as silicon dioxide. As discussed previously, the goal of the planarization process is to abrasively remove protrusions 14 without disturbing the long-range surface gradation. In other words, after polishing the surface, wafer 15 should conform to the longitudinal waviness of the wafer as represented by dashed line 13.

The problem with the conventional soft pad 11 is that it lacks sufficient rigidity such that it renders the polishing process highly inefficient. Although pad 11 conforms well to the long range gradation 13, its localized polishing inefficiency makes the complete removal of protrusions 14 very difficult to achieve. Usually, the single layer soft pad 11 (e.g., typically a Rodel SUBA 4 pad) only succeeds in rounding the edges of protrusions 14 without adequately planarizing the surface topography.

Figure 2:
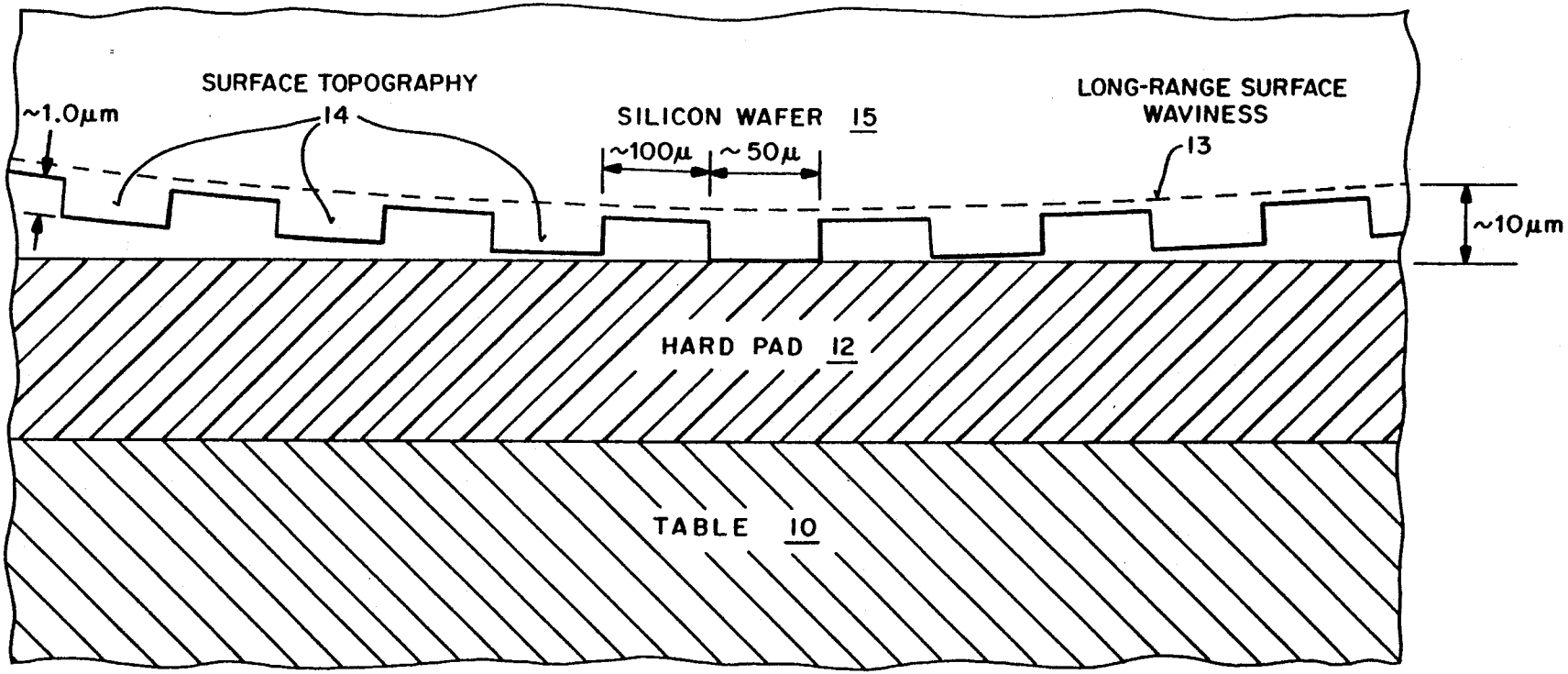
FIG. 2 (PRIOR ART)
FIG. 2 is a cross-sectional view of another prior art polishing pad.

FIG. 2 shows another prior art approach in which a relatively hard pad (e.g., such as a Rodel IC-60 pad) is attached to support table 10. While hard pad 12 is quite effective in removing the protrusions 14 which it comes in contact with, its high rigidity prevents it from conforming to the long range surface waviness 13. This means that portions of wafer 15 will end up being completely polished, or even over polished, while other portions will be under polished. (Note that the dimensions indicated in FIG. 2 are typical dimensions provided for illustrative purposes only. Obviously, actual dimensions, spacings etc. will vary over a tremendous range. Therefore, the numbers provided should not be taken as a limitation on the scope of the present invention.)

Figure 3:
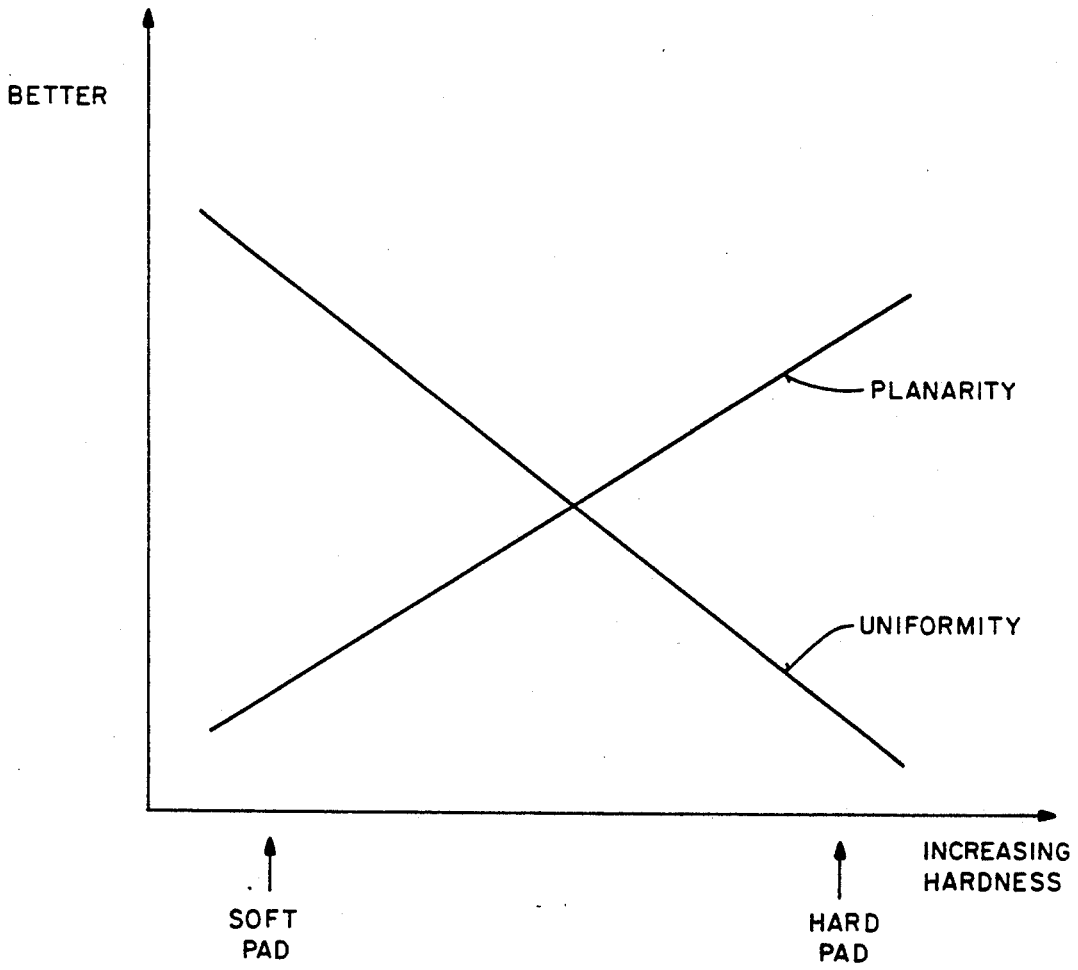
FIG. 3 is a graph illustrating the tradeoff between planarity and uniformity for a conventional polishing pad.

FIG. 3 illustrates graphically the trade-off involved between the soft pad 11 of FIG. 1 and the relatively hard pad 12 of FIG. 2. While the soft pad provides very good uniformity of polishing across the wafer, planarity suffers. On the other hand, the hard pad provides excellent planarity at the cost of poor uniformity. In addition, because of its hard upper surface, pad 12 is hydrophobic—meaning that it is poor from the standpoint of acting as a slurry transport mechanism.

Figure 4:
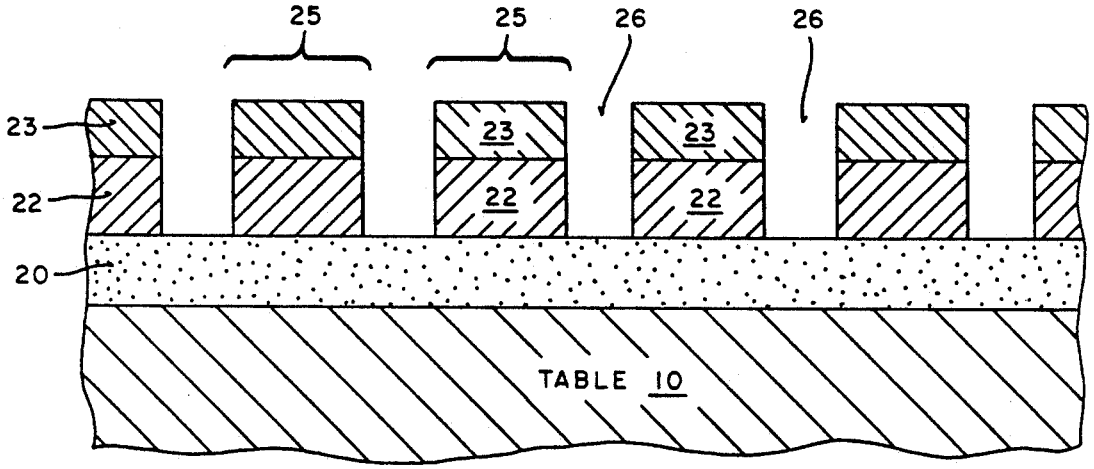
FIG. 4 is a cross-sectional view of the currently preferred embodiment of the composite pad of the present invention.

FIG. 4 is a cross-sectional view of the currently preferred embodiment of the composite pad of the present invention. The pad of FIG. 4 comprises three distinct layers, the combination of which allows optimization of a number of independent polishing parameters.

The first layer, layer 20, comprises a relatively soft, elastic material attached to the upper surface of support table 10. Preferably, layer 20 comprises a silicone sponge rubber or foam rubber having a thickness on the order of one millimeter. Next, a layer 22 of rigid material covers the top of layer 20. In the currently preferred embodiment layer 22 comprises a composite fiberglass epoxy material which is well known for its extreme rigidity and hardness. In the currently preferred embodiment, the thickness layer 22 is on the order of one millimeter thick.

The third or upper most layer 23 of the invented composite polishing pad comprises a spongy, porous material which functions as a slurry carrier. Since layer 23 is in contact with the silicon surface during planarization processing, it needs to be capable of transporting slurry across the wafer; hence, the reason behind the open cell or porous nature of layer 23. It is also desirable to make layer 23 highly flexible so as to be able to conform to the localized incongruities of the silicon substrate surface. In the currently preferred embodiment, layer 23 comprises a pad material manufactured by Rodel known by the name "SUBA-500". Preferably, the thickness of layer 23 is in the range of 0.1 to 2.0 millimeters thick. Other embodiments may employ thicknesses beyond this range.

Figure 6:
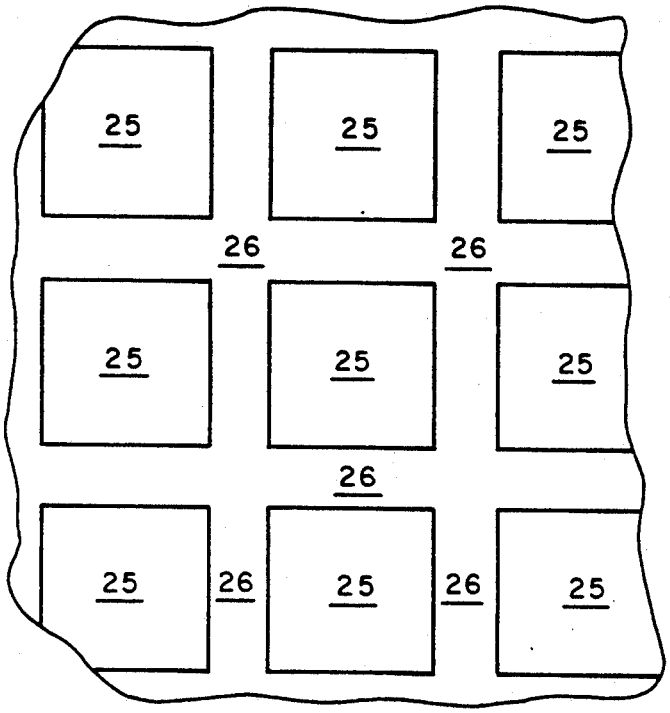
FIG. 6 is a top view of the composite pad shown in FIG. 4.
Figure 7:
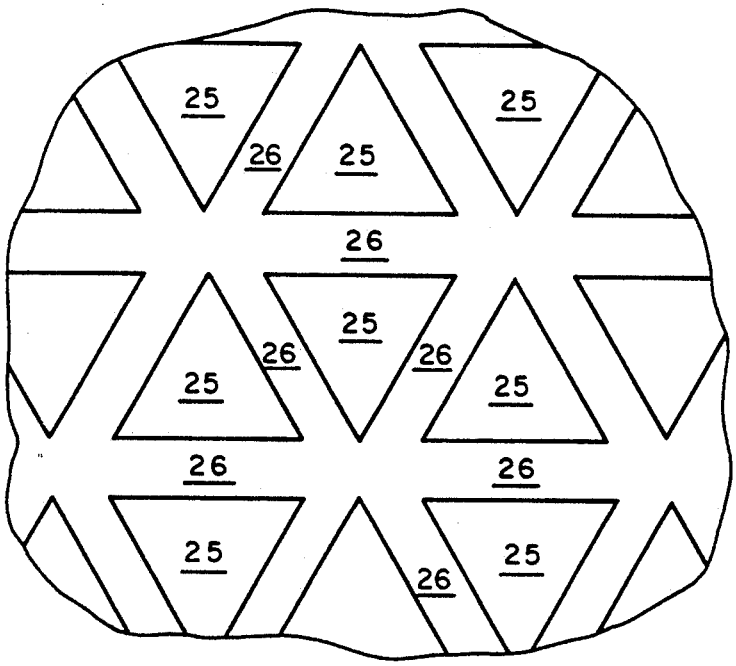
FIG. 7 is a top view of an alternative embodiment of the present invention which utilizes a triangular segmented pattern.
Figure 8:
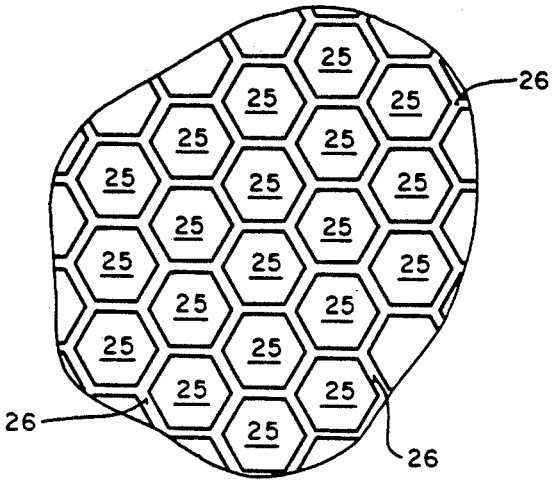
FIG. 8 is a top view of an alternative embodiment of the present invention using a hexagonal segmented pattern.

Notice in FIG. 4 that layers 22 and 23 appear segmented. FIG. 6 shows a top view of the composite pad cross-section of FIG. 4. The segmentation of the second and third layers results in the formation of a plurality of tiles 25 separated by channels 26. The tiles 25 in FIG. 6 appear as squares, spaced equidistant from one another. In practice, the tile pattern created by segmentation of the second and third layers may take a variety of forms. By way of example, FIG. 7 illustrates a top view of a composite pad in which segmented tiles 25 appear triangular in shape. FIG. 8 shows yet another possibility in which the composite pad of the present invention is formed into a plurality of hexagonal-shaped tiles 25 separated by channels 26. Obviously, a multitude of different tile shapes and patterns are possible—each being considered to be well within the spirit and scope of the present invention.

The reason for patterning layers 23 and 22 into tiles 25 is that segmentation physically isolates individual tiles 25 from one another. That is, vertical (i.e., up/-down) movement of a given tile is not imparted or transferred to any of its neighboring tiles. Any downward pressure on an individual tile is absorbed by the underlying elastic layer 20 and is not coupled to any adjacent tiles. So, in effect, each tile segment is independently suspended on table 10. This aspect of the present invention is further illustrated in the cross-sectional drawing of FIG. 9.

Figure 9:
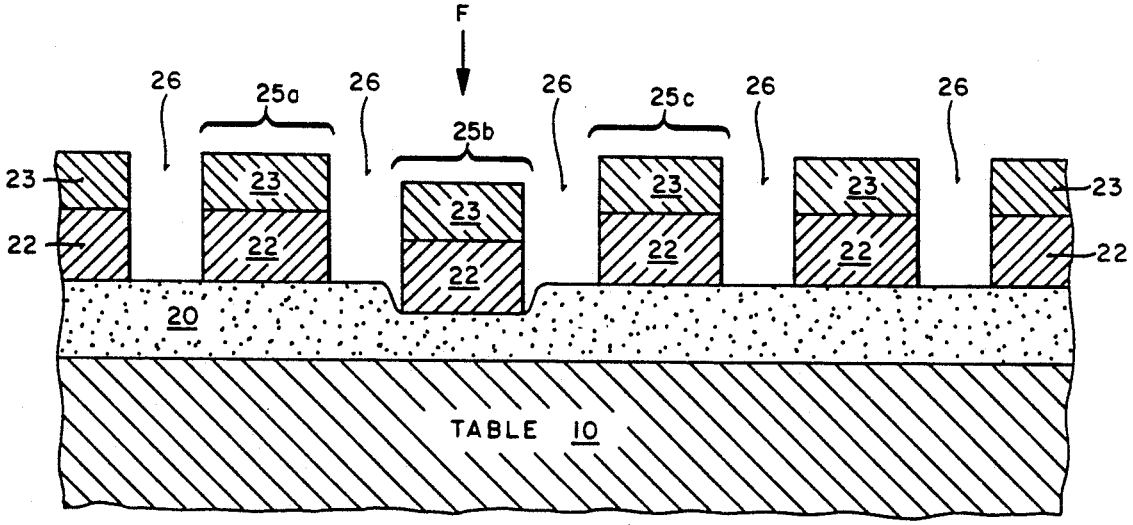
FIG. 9 is a cross-sectional view of the present invention illustrating the concept of independent suspension of the segmented tiles.

FIG. 9 shows a tile 25*b* being subjected to a downward force F. Because of the resiliency and hardness of layer 22, this downward force is absorbed by the small portion of layer directly below tile 25*b*. (Layer 23, because of its porous nature, also compresses somewhat, although this is not shown explicitly in FIG. 9). Due to the physical nature of layer 20, and the segmentation between the individual tiles 25, only a negligible amount of the downward force applied to tile 25*b* is coupled or transferred to its neighboring tiles 25*a* or 25*c*. In other words, the elasticity of layer 20, together with the presence of channels 26, function as a means for independently suspending individual tiles 25. This allows tiles 25 to move up and down to conform to the long-range contour of the wafer during polishing. Thus, the segmented composite pad of the present invention is able to conform to the longitudinal gradiations of a silicon substrate while still achieving localized planarization.

It should be appreciated that each of the layers in the presently invented pad function in concert to produce the desired polishing result—each layer serving a different purpose. The upper-most layer 23, as explained earlier, is optimized for slurry transport; middle layer 22 provides good short-range planarity; and bottom layer 20 allows the pad to conform to the long-range waviness of the substrate, thereby achieving a high level of uniformity of polishing across the wafer.

Segmentation of the layers may be produced by a variety of methods. In the preferred embodiment, layers 20, 22 and 23 are placed over table 10 in that order. Then, the upper two layers are subjected to saw blade cutting. In this manufacturing approach, the width of channels 26 is determined by the width of the saw blade. Other methods, such as chemical etching, are also possible. Currently, channels 26 are on the order of one millimeter wide with tiles 25 being approximately 2 $cm^2$. The lateral dimension of tiles 25 is optimally selected to correspond approximately to the width of an individual die on wafer 15. In practice it has been determined that good localized planarity is achieved when the width of the tiles roughly corresponds to the width of the individual die.

An additional benefit of the segmented pad of the present invention is that spaces 26 between tiles 25 also provide a means for efficient channeling of slurry about the surface. Channeling slurry in this manner greatly improves the distribution of slurry around the water, thereby, improving the polishing performance of the pad.

Figure 5:
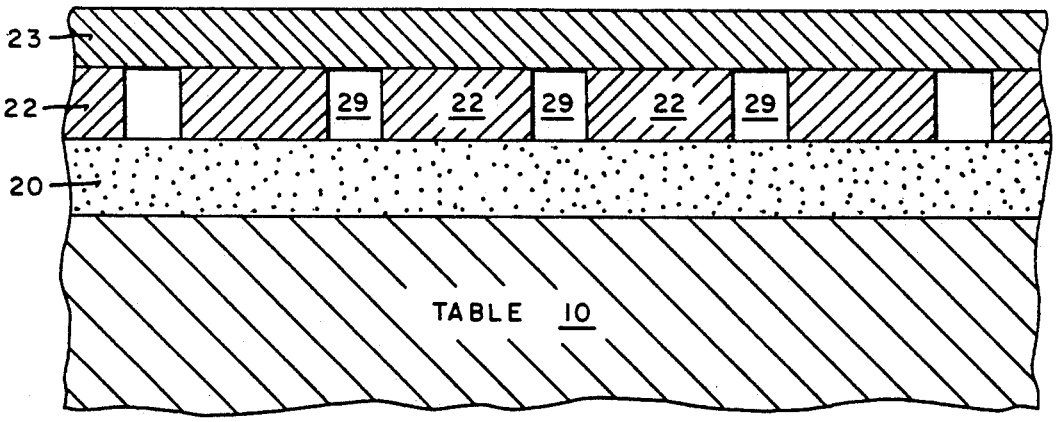
FIG. 5 is a cross-sectional view of an alternative embodiment of the present invention.

FIG. 5 shows an alternative embodiment of the present invention which includes first and second layers 20 and 22, respectively, as described above. Layer 22 is segmented to produce individual tiles separated by spaces or channels 29. Covering this segmented layer is a continuous sheet of material 23. Just as before, layer 23 comprises a material optimized for transport of slurry. Again while layer 22 comprises a rigid material, while layer 20 comprises a spongy, elastic material.

The principle of operation for the pad of FIG. 5, is basically the same as that of FIG. 4. In other words, individual tile sections are designed to move vertically—independent from one another—by means of spaces 29 and the underlying compressible material comprised of layer 20.

Note that slight coupling between adjacent tiles may take place in this embodiment due to the continuous nature of layer 23. However, it should be understood that layer 23 is intentionally made highly flexible, and preferably is manufactured as thin as possible (e.g., less than 0.5 millimeters thick). The primary advantage offered by the embodiment of FIG. 5 is added durability. Because the polishing process is inherently abrasive, there maybe a tendency for individual tiles to tear off or become damaged in the embodiment of FIG. 4. The pad of FIG. 5 overcomes this possibility by presenting a continuous, soft, upper layer for contact with the silicon substrate surface.

Whereas the present invention has been described in conjunction with specific embodiment types, it is to be understood that the particular embodiments shown and described by way of illustration are in no way intended to be considered limiting. Reference to the details of the preferred embodiment is not intended to limit the scope of the claims which themselves recite only those features regarded as essential to the invention.

We claim:

1. In an apparatus for planarizing a surface of a semiconductor substrate said apparatus including a support table covered with a polishing pad, a means for coating said pad with an abrasive slurry, and a means for forcibly pressing said substrate against said pad such that movement of said substrate relative to said table results in planarization of said surface, an improved polishing pad comprising:

a first layer of elastic material attached to said table;

a second layer of material covering said first layer;

a third layer of material for transporting said slurry, said third layer covering said second layer and making contact with said substrate during said process:

said second layer being segmented into individual rigid sections physically isolated from one another in the lateral dimension, each section being resilient across its width yet cushioned by said first layer in the vertical direction.

2. The improvement of claim 1 wherein said third layer is also segmented in alignment with said sections of said second layer, thereby creating a plurality of passages which channel said slurry.

3. The improvement of claim 1 or 2 wherein said surface of said substrate comprises a dielectric layer characterized by localized height variations.

4. The improvement of claim 3 wherein said first layer comprises foam rubber.

5. The improvement of claim 4 wherein said first layer is about one millimeter thick.

6. The improvement of claim 3 wherein said second layer comprises a fiberglass epoxy.

7. The improvement of claim 6 wherein said second layer is about one millimeter thick.

8. The improvements of claim 3 wherein said third layer comprises a porous material optimized for slurry transport.

9. The improvement of claim 8 wherein said third layer is between 0.1 and 2.0 millimeters thick.

10. The improvement of claim 3 wherein said passages are approximately one millimeter wide.

11. The improvement of claim 3 wherein said individual sections have a width approximately matched to said localized height variations of said dielectric layer.

12. The improvement of claim 11 wherein said individual sections are between 0.5 and 4.0 centimeters wide.

13. In an apparatus for planarizing localized height variations across a surface of a semiconductor substrate, said substrate also having longitudinal gradations in height across said surface, said apparatus including a support table covered with a polishing pad, a means for coating said pad such that movement of said substrate relative to said table planarizes said localized height variations, an improved polishing pad comprising:

a first layer of compressible material attached to said table;

a plurality of segmented tiles covering said first layer, each of said tiles comprising a rigid intermediate layer of material attached to said first layer covered by a surface layer of spongy material for transporting said slurry, said surface layer making contact with said substrate during said process;

each of said tiles being mechanically isolated from one another in the lateral dimension and cushioned by said first layer in the vertical dimension such that said plurality of tiles act in concert to planarize said localized height variations without affecting said longitudinal gradations of said substrate.

14. The improvement of claim 12 wherein said tiles are physically separated from one another in said lateral dimension.

15. The improvement of claim 12 wherein said tiles are spaced equidistance from one another in said lateral dimension.

16. The improvement of claim 13 wherein said localized height variations comprise a patterned dielectric layer formed on said surface of said substrate.

17. The improvement of claim 16 wherein said first layer of material is formed to a thickness of about one millimeter.

18. The improvement of claim 17 wherein said first layer of material comprises foam rubber.

19. The improvement of claim 17 wherein said second layer of material is formed to a thickness of about one millimeter.

20. The improvement of claim 19 wherein said second layer comprises a fiberglass epoxy.

21. The improvement of claim 19 wherein said surface layer of material is formed to a thickness in the range of 0.1 and 2.0 millimeters.

22. The improvement of claim 21 wherein said surface layer of material is optimized for transport of said slurry.

23. The improvement of claim 22 wherein said tiles have a width on the same order as the width of said localized height variations.

24. In an apparatus for planarizing localized height variations of a dielectric layer formed on a surface of a semiconductor substrate, said substrate also exhibiting longitudinal gradations in height across said surface, said apparatus including a support table covered with a polishing pad, a means for coating said pad with an abrasive slurry, and a means for pressing said substrate against said pad such that movement of said substrate relative to said table planarizes said localized height variations, an improved polishing pad comprising:

a first layer of compressible material attached to said table;

a plurality of segmented tiles covering said first layer, each of said tiles comprising a rigid, intermediate layer of material attached to said first layer;

a surface layer of spongy material optimized for transport of said slurry, said surface layer covering said tiles and making contact with said substrate during said process;

said tiles being mechanically isolated from one another in the lateral dimension and cushioned by said first layer in the vertical dimension such that said tiles act in concert to planarize said localized height variations while conforming to said longitudinal gradations.

25. The improvement of claim 24 wherein said surface layer is segmented in alignment with said tiles, thereby creating a plurality of slots which channel said slurry.

26. The improvement of claim 24 or 25 wherein said tiles are separated from one another equidistant in said lateral dimension.

27. The improvement of claim 26 wherein said first layer of material is approximately 1.0 millimeters thick.

28. The improvement of claim 27 wherein said tiles are approximately 1.0 millimeters thick.

29. The improvement of claim 28 wherein said surface layer has a thickness in the range of 0.1 to 2.0 millimeters thick.

30. The improvement of claim 29 wherein said first layer comprises foam rubber and said second layer comprises a fiberglass epoxy.

* * * * *